US005469139A

United States Patent [19]

Ko

[11] Patent Number: 5,469,139

[45] Date of Patent: Nov. 21, 1995

[54] DOOR BLOCK ALARM

[76] Inventor: Joseph Y. Ko, 12 Morning Dove, Laguna Niguel, Calif. 92677

[21] Appl. No.: 389,291

[22] Filed: Feb. 16, 1995

[51] Int. Cl.[6] ..... G08B 13/08

[52] U.S. Cl. ..... 340/545; 200/61.93; 340/542; 340/665

[58] Field of Search ..... 340/545, 665, 340/542, 565; 70/93; 292/268, 270; 200/61.93

[56] References Cited

U.S. PATENT DOCUMENTS 372,326 11/1887 Palmenberg ..... 292/268
3,263,040 7/1966 Bliven ..... 340/545
3,406,386 10/1968 Hawkins ..... 340/545
3,810,145 5/1974 Gusaras ..... 340/665
4,360,803 11/1982 Heiland ..... 340/665
5,250,927 10/1993 Nevels ..... 200/61.93

*Primary Examiner*—Glen Swann
*Attorney, Agent, or Firm*—Knobbe, Martens, Olson & Bear

[57] ABSTRACT

A latch and alarm device for securing a door activates an alarm of 110–120 decibels for approximately 60 seconds if a force on the door exceeding about 20–30 pounds is detected. The device may be used with either left or right-hinged doors. A panic switch on the device may be used in an emergency to activate the high-output alarm.

12 Claims, 3 Drawing Sheets

Fig. 6
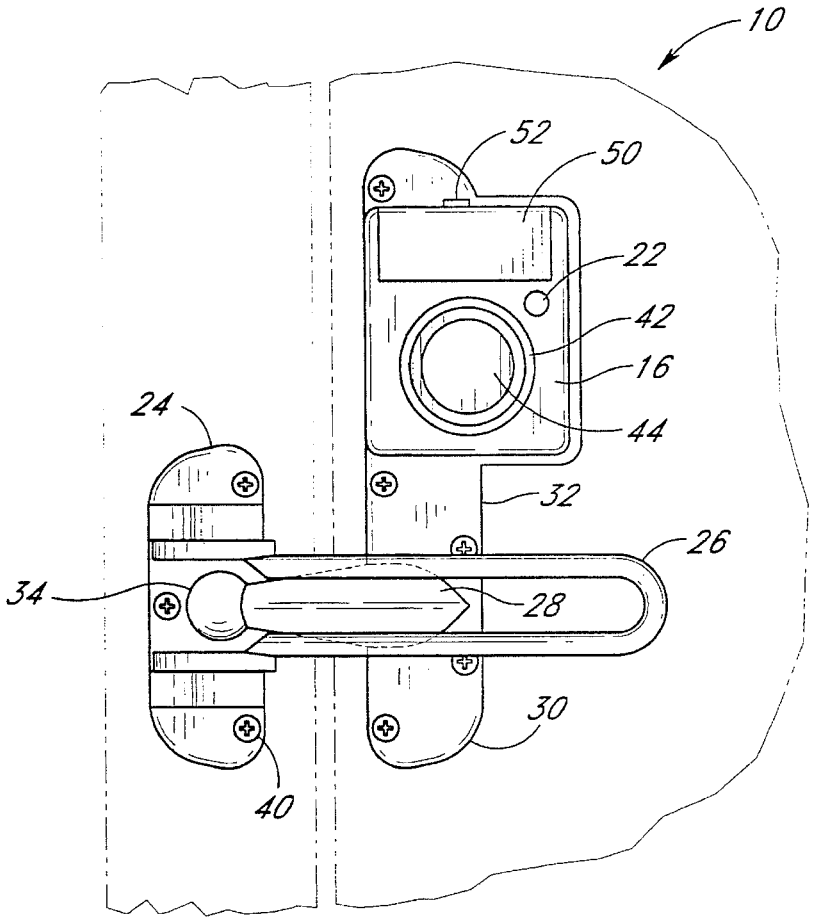
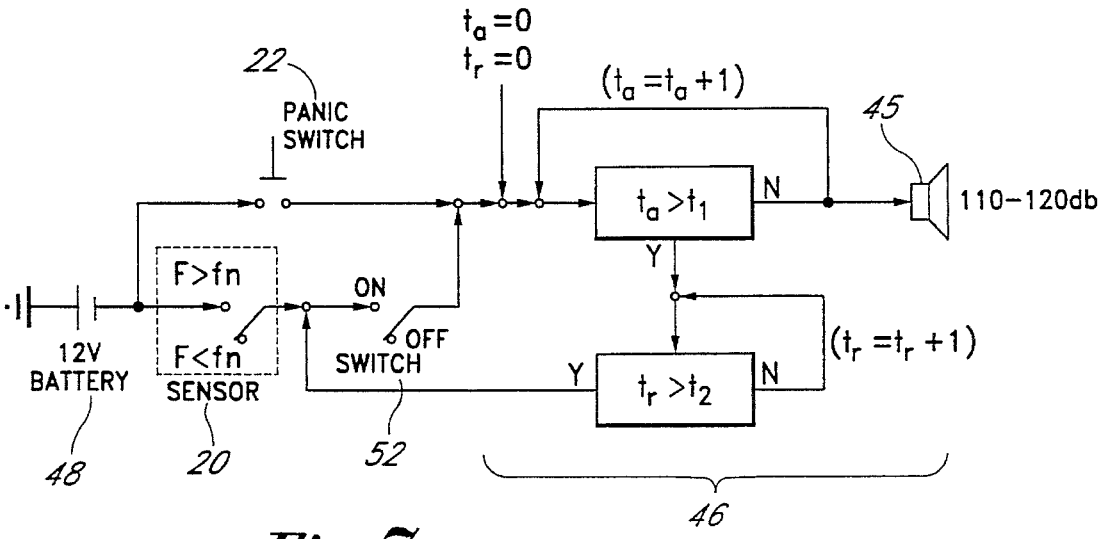
Fig. 7

DOOR BLOCK ALARM

BACKGROUND OF THE INVENTION

The door block alarm of the present invention relates generally to the field of home security devices, and, in particular, to a latch and alarm device that is responsive to forced entry through a door.

Security devices for the doorway of a home include simple and inexpensive bolts and locks, as well as more complex and expensive electronic systems. The former can be installed by the homeowner with simple tools and do not require modification of the door or frame. The latter are normally installed by a skilled professional and require modification of the door, the frame and/or surrounding walls.

Door bolts and locks are a small deterrent to intruders capable of either circumventing the devices or breaking them to gain entry. In many areas, the noise from breaking and entering is not heard by neighbors. At best, these devices delay the intruder momentarily.

Electronic security systems offer the advantages of remote notification of authorities, as well as loud alarms to draw attention to the activity. However, in addition to their expense and complexity, these systems require a constant electric power supply for operation. A knowledgeable intruder would simply cut off power to the home to completely pass the security system.

In view of the foregoing, a need exists for an improved door alarm that overcomes the problems mentioned.

SUMMARY OF THE INVENTION

The door block alarm of the present invention overcomes the aforenoted disadvantages by using a latch mechanism and a force sensor with a simple, high output alarm unit. The latch and alarm device is easily installed by the homeowner. It is powered by a replaceable battery, so there is no reliance upon an electric power supply.

In the present invention, a rotatable latch is mounted to the frame of a door and captures an arm mounted to a plate on the door. The battery-operated alarm unit is also mounted on the plate on the door. When the latch is closed and an ON/OFF switch is set to ON, any force on the door exceeding a nominal amount of force activates an alarm.

In the preferred embodiment, the nominal value is about 20–30 pounds, and activates an alarm of 110–118 decibels. A panic switch may also be pressed in an emergency, thereby activating the alarm without detection of a large force upon the door. The battery in this embodiment is a 12 volt. The door block alarm of the present invention may be used with either a left- or right-hinged door.

Thus, advantages of the present invention include its simple construction and easy installation, its battery operation, its door blocking, and its force-sensitive, high-output alarm. The door latch provides immediate obstruction of the attempted entry, and the alarm loudly announces an intruder's presence to persons in the house and nearby.

Further advantages and applications will become apparent to those skilled in the art from the following detailed description and the drawings referenced herein.

BRIEF DESCRIPTION OF THE DRAWINGS

FIG. 6 is a front plan view of an alternate embodiment of the present invention, wherein the door block alarm of the present invention is mounted to the left side of a right-hinged door.

FIG. 7 is a simplified schematic of the door block alarm of the present invention, illustrating the coupling of the switches with the battery, sensor, and alarm unit.

DETAILED DESCRIPTION OF THE PREFERRED EMBODIMENT

Figure 1:
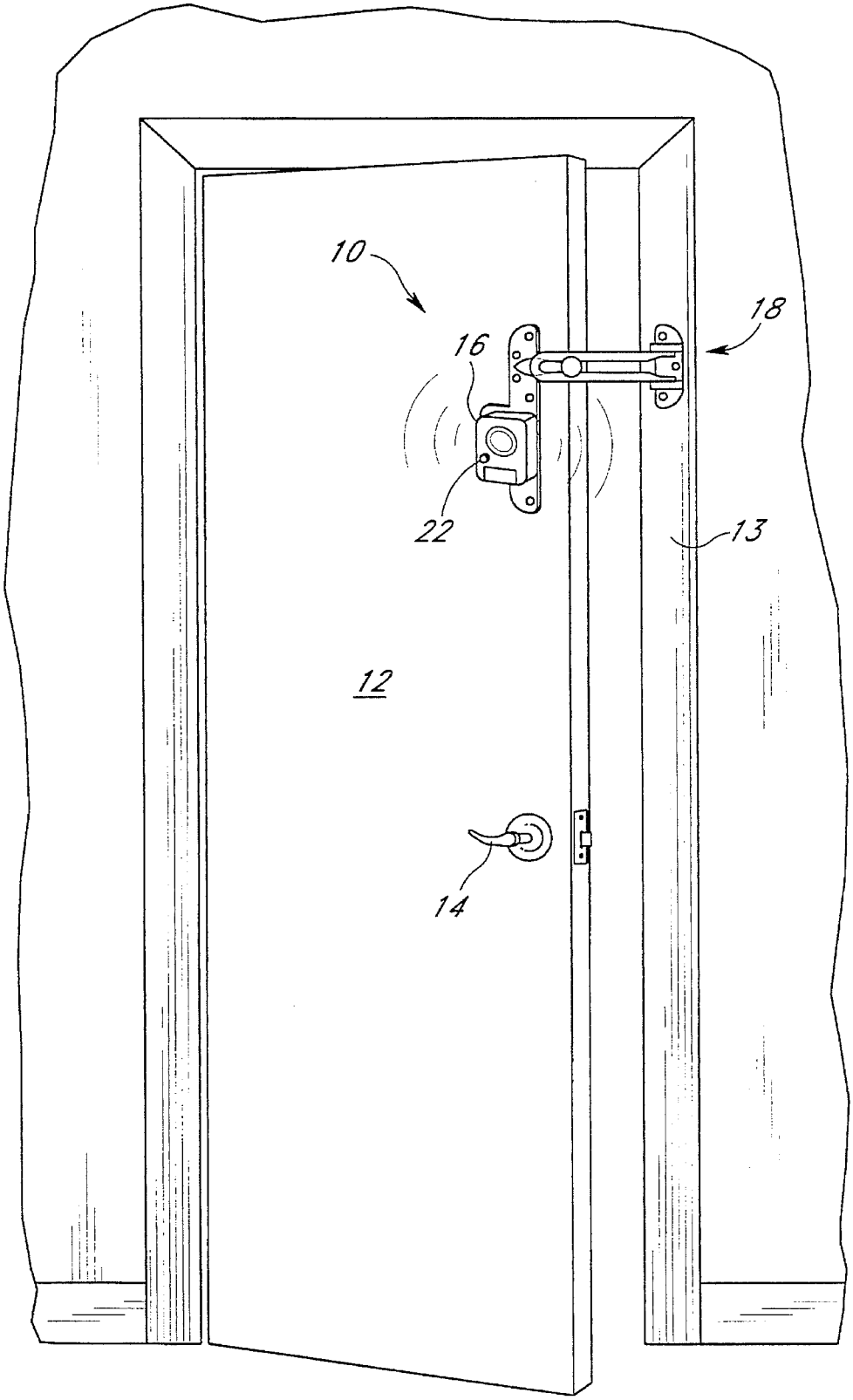
FIG. 1 is a perspective view of a preferred embodiment of the present invention, illustrating the mounting of the door block alarm to the right side of a left-hinged door.

A preferred embodiment of a door block alarm of the present invention is illustrated in FIG. 1, and generally referenced by the numeral 10. The alarm is mounted on the opening, or right, side of a left-hinged door 12. Although, as described below, the alarm may alternately be mounted on the left side of a right-hinged door.

The alarm 10 is preferably located where standard latches are presently located, that is, above a door handle 14. And, its alarm housing 16 is located below a latch assembly 18 of the alarm 10. Should an intruder attempt to force the door 12 open, he will most probably use his shoulder and upper body strength to do so, at a location close to the opening side of the door 12. The alarm housing 16 includes a force sensor 20, such that the intruder's force on the door 12 is applied at nearly the location of the alarm 10 of the present invention. Due to this relatively optimum positioning, the applied force need not be great in order to activate the alarm 10. That is, only a relatively small threshold or nominal value of force is required for detection by the sensor 20. A panic switch 22 is further provided on the alarm 10 of the present invention, whereby a resident may depress the switch 22 for immediate activation of the alarm 10.

Figure 2:
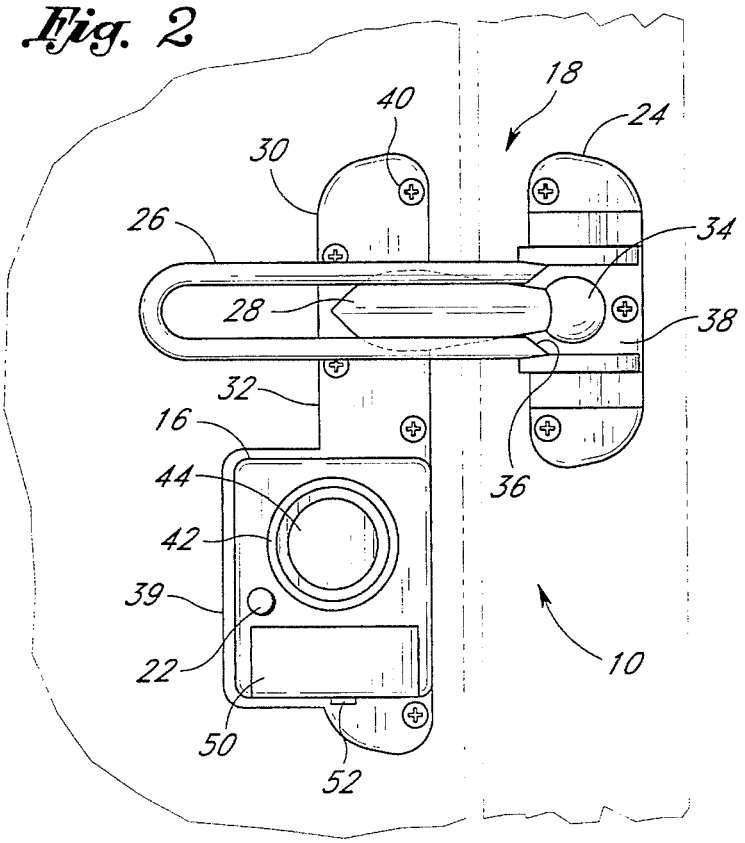
FIG. 2 is a front plan view of the preferred embodiment of FIG. 1, illustrating the mounting of the arm and alarm housing to the door and the mounting of the latch to the door frame.

Referring in detail to the preferred embodiment more clearly illustrated in FIG. 2, a latch plate 24 is mounted to the right door frame 13. A rotatable, "U"-shaped latch 26 is attached to the plate 24 and positioned such that rotating the latch 26 in the left direction will engage an arm 28 located on an upper portion 30 of a mounting plate 32. The latch 26 rotates in a horizontal plane that is perpendicular to the door frame 13.

The mounting plate 32 is aligned near the right edge of the door 12 such that the arm 28, and, in particular, its free end 34, is easily received at a base 36 of the latch prongs. The preferably rounded free end 34 of the arm 28 is slightly wider than the opening between the prongs of the latch 26. In the fully closed, or leftmost position, of the latch 26, and with the door 12 closed, the free end 34 of the arm 28 should extend at least over a base 38 of the latch 26 on the latch plate 24, as illustrated in FIG. 2. In alternate embodiments, the latch assembly 18 may be replaced by a deadbolt assembly, and the alarm housing 16 may be positioned above or horizontally adjacent the locking mechanism, without loss of the advantages of the present invention.

The mounting plate 32 is shown as a flat, "d"-shaped element, where a lower, broader portion 39 is sized to accommodate the relatively square alarm housing 16. However, it is understood that both the mounting plate 32 and housing 16 may comprise other shapes, such as rectangles or semi-circles. As illustrated in FIG. 2, the latch and mounting plates 24, 32 are preferably secured to the door frame 13 and door 12, respectively, via screws 40. The housing 16 may be attached to the mounting plate 32 by an adhesive, particularly if constructed of plastic, as is preferred. Or, if a metallic housing is utilized, soldering or other means known to those skilled in the art may be employed to attach the housing 16 to the mounting plate 32. The latch assembly 18 and mounting plate 32 are preferably of a metallic construction.

The alarm housing 16 of the preferred embodiment of the present invention includes a circular depression 42 within which is located a raised, circular dome cover 44 for a diaphragm (not shown) of an alarm unit 46. The cover 44 acts as a speaker 45, where the circular shape aids in dispersing the sound. The diaphragm and its connected leads (not shown) are both contained within the alarm housing 16 as part of the high output alarm unit 46 and are constructed in a manner well known to those skilled in the art.

Figure 5:
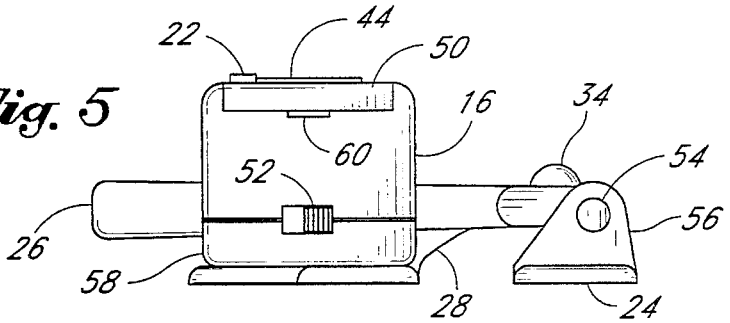
FIG. 5 is a bottom end view of the embodiment of FIG. 1, illustrating the ON/OFF switch for electrically coupling/decoupling an alarm unit with a force sensor and a battery.

The alarm unit 46 is preferably powered by a replaceable, 12 Volt battery 48, installed beneath a cover 50 of the battery compartment, as illustrated in FIGS. 2 and 5. As illustrated schematically in FIG. 7, the battery 48 is electrically coupled/decoupled to the alarm unit 46 and the force sensor 20 by an ON/OFF switch 52. The panic switch 22 is preferably a raised button which, when depressed, overrides the sensor 20 and ON/OFF switch 52 to couple the battery 48 with the alarm unit 46 and emit an alarm sound of 110–120 decibels (db), or preferably 115 db. This sound level is considered deafening and is comparable to standing next to a riveter. The upper power level (near 120 db) is close to the level where thunder is felt. Thus, the panic switch 22 may be used to activate the alarm sound in an emergency whether the door 12 is being forced open or not, and effectively alerts anyone nearby that there is a dangerous situation.

Figure 3:
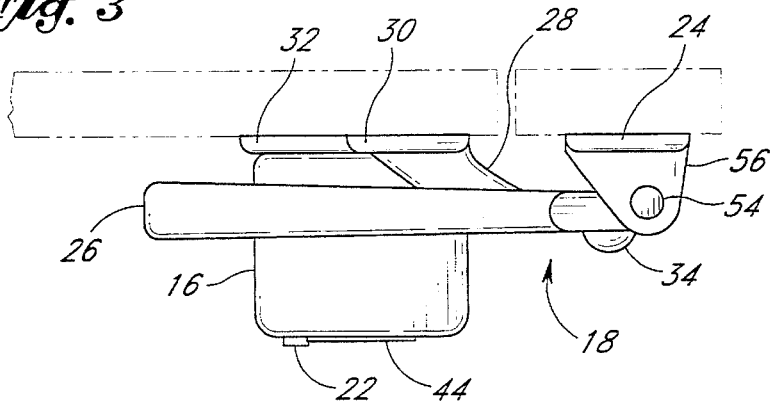
FIG. 3 is a top end view of the embodiment of FIG. 1, illustrating the capture of the arm by the latch.
Figure 4:
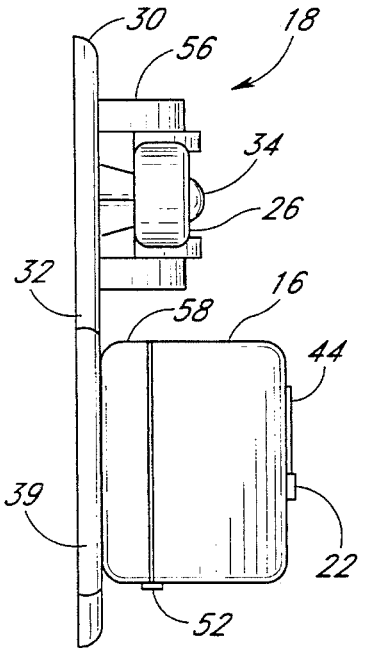
FIG. 4 is a left side view of the embodiment of FIG. 1, illustrating the latching mechanism on an upper portion of the mounting plate and an alarm housing on a lower portion.

Referring now to FIGS. 3 and 4, the capture of the arm 28 by the latch 26 is more clearly illustrated. The latch 26 pivots on pins 54 received in support members 56 on the latch plate 24, and the latch 26 needs only to rotate to be substantially parallel with the door surface, without contacting the door 12. This position ensures that when the door 12 is opened, the door 12 and arm 28 will swing out and make contact with the latch 26, and the arm 28 will be held between the latch prongs thereby obstructing further opening of the door 12. The use of force on the door 12 to gain entry will then activate the alarm 10.

The sensor 20 of the alarm 10 of the present invention is precalibrated by the manufacturer to detect forces greater than a nominal value, $f_n$, or preferably about 20–30 pounds, before activation of the alarm unit 46. A vibration sensor such as a piezoelectric crystal unit, well known to those skilled in the art, may be used for the force detection. The piezoelectric material is capable of varying its output charge in direct proportion to the stress applied. Alternately, a bonded strain gage may be used for force detection and uses an element of known force-strain relationship such that its electrical resistance changes with the applied strain. The sensor 20 is mounted within the alarm housing 16 such that it contacts the inside of a back section 58 of the housing 16 that attaches to the mounting plate 32.

FIG. 5 illustrates the ON/OFF switch 52 and battery compartment, located at the easily accessed bottom end of the alarm 10. A slot 60 adjacent the battery cover 50 facilitates its opening, where a thumbnail or tool may be used to pry the cover 50 off to reveal the battery 48 for possible replacement.

FIG. 6 illustrates an alternate mounting of the door block alarm 10 of the present invention, wherein the alarm housing 16 is positioned above the latch assembly 18 and the alarm 10 is mounted on the left side of a right-hinged door. In this arrangement, the latch assembly 18 may be located slightly lower than illustrated in FIG. 1 with respect to the door handle 14. That is, in order to position the alarm housing 16 containing the force sensor 20 closer to the probable point of application of force by an intruder, the mounting plate 32 may be placed slightly lower on the door.

A simplified schematic of the door block alarm 10 of the present invention is illustrated in FIG. 7. The activation by combined switch 52 ON setting and force detection is represented, as is the override activation by the panic switch 22. Of course, both methods of activation are dependent upon a charged battery as the power source. In the preferred embodiment of the present invention, the alarm sound is emitted for 60 seconds ($t_1$), and then has a retrigger delay of approximately 3 seconds ($t_2$) before resounding if the ON/OFF switch 52 is not set to OFF. The timers $t_a$, $t_r$ of the alarm unit 46 may be simple counters or other mechanisms well known to those skilled in the art.

The door block alarm of the present invention may be used to complement other simple locking mechanisms, such as a door lock of the handle. Likewise, the battery-operated alarm of the present invention may be used to back up a more complicated electronic system. The embodiments illustrated and described above are provided merely as examples of the preferred construction of the present invention. Other changes and modifications may be made from the embodiments presented herein by those skilled in the art without departure from the spirit and scope of the invention, as defined by the appended claims.

What is claimed is:

1. A latch and alarm device for doors, comprising:

a mounting plate including a first and second portion and having an arm extending substantially perpendicular to said first portion, said mounting plate configured to be mounted on a door;

a latch plate adapted to be mounted on the frame of the door and including a rotatable latch for capturing said arm so that motion of the door is limited;

a high output alarm unit operated by a battery;

a force sensor for detecting attempted forced entry through the door;

an ON/OFF switch for electrically coupling/decoupling said alarm unit and said sensor from said battery;

a panic switch for immediate activation of said alarm unit; and a housing mounted on said second portion of said mounting plate and including said alarm unit, said sensor, said switches and said battery, whereby when a) said arm is captured in said latch, b) said ON/OFF switch is set to ON, and c) a force greater than a nominal value is detected, said alarm unit emits an alarm sound.

2. The device of claim 1, wherein said mounting plate and said latch plate are usable with either left-hinged doors or right-hinged doors.

3. The device of claim 1, wherein said alarm sound is at least about 110 decibels.

4. The device of claim 1, wherein said alarm sound is emitted for about 60 seconds.

5. The device of claim 1, wherein said battery is a 12 Volt battery.

6. The device of claim 1, wherein said mounting plate and said latch plate are mounted by screws to the door and door frame, respectively.

7. The device of claim 1, wherein said nominal value of said force is about 20–30 pounds.

8. A method of securing a door, comprising the steps of:

a) installing a latch plate on the frame of the door, said latch plate including a rotatable latch;

b) installing a mounting plate on the door such that an arm on said mounting plate aligns with said latch, said mounting plate including a housing for an alarm unit, a force sensor, a battery, and an ON/OFF switch;

c) rotating said latch in order to capture said arm; and d) positioning said switch to ON to electrically couple said alarm unit and said sensor to said battery, such that if a force greater than about 20 pounds is detected, said alarm unit emits an alarm sound for approximately 60 seconds.

9. The method of claim 8, wherein steps a) and b) involve installing said plates on the right side for a left-hinged door.

10. The method of claim 8, wherein steps a) and b) involve installing said plates on the left side for a right-hinged door.

11. The method of claim 8, wherein steps a) and b) involve installing said plates using screws.

12. The method of claim 8, further comprising the step of pressing a panic switch to activate said alarm sound.

* * * * *